US005366179A

United States Patent [19]

Manhalter

[11] Patent Number: 5,366,179

[45] Date of Patent: Nov. 22, 1994

[54] METHOD OF INITIATING THE DETONATION OF A WARHEAD AND ARRANGEMENT FOR IMPLEMENTING THE METHOD

[75] Inventor: Anton Manhalter, Nersingen, Germany

[73] Assignee: Deutsche Aerospace AG, Munich, Germany

[21] Appl. No.: 94,976

[22] Filed: Jul. 22, 1993

[30] Foreign Application Priority Data

Jul. 22, 1992 [DE] Germany ..... 4224020

[51] Int. Cl.[5] ..... F41G 7/28; F42C 13/04

[52] U.S. Cl. ..... 244/3.19; 244/3.15; 102/214

[58] Field of Search ..... 244/3.15, 3.17, 3.19; 342/68, 94, 95, 97, 101; 102/214

[56] References Cited

U.S. PATENT DOCUMENTS

| | | | |
|---|---|---|---|
| 3,081,050 | 3/1963 | Lapham, Jr. et al. | 244/3.19 |
| 3,858,207 | 12/1974 | Macomber et al. | 342/95 |
| 4,096,480 | 6/1978 | Miner et al. | 342/68 |
| 4,227,195 | 10/1980 | Salerno et al. | 342/189 |
| 4,236,157 | 11/1980 | Goss et al. | 342/68 |
| 4,360,812 | 11/1982 | Peperone | 342/128 |
| 4,382,258 | 5/1983 | Tabourier | 342/110 |
| 4,383,663 | 5/1983 | Nichols | 244/3.16 |
| 4,599,616 | 7/1986 | Barbella et al. | 342/68 |

FOREIGN PATENT DOCUMENTS

| | | |
|---|---|---|
| 2009422 | 11/1974 | Germany . |
| 2042694 | 9/1980 | United Kingdom . |

*Primary Examiner*—Ian J. Lobo

*Attorney, Agent, or Firm*—Spencer, Frank & Schneider

[57] ABSTRACT

A method of initiating the detonation of a warhead of a friendly guided missile and an arrangement for implementing the method. If a friendly guided missile or flying body, during its target approach phase, approaches an enemy missile or flying body, the active radar target seeker of the friendly guided missile is switched to perform a fine range discrimination, and an additional modulated signal is transmitted by the transmit/receive antenna of the active radar target seeker of the friendly guided missile, with this additional signal being received again after reflection at the enemy missile. With the aid of the received signal, the evaluation and control unit of the active radar target seeker generates an image of the enemy missile and determines the position of the warhead within the enemy missile. The warhead of the friendly guided missile is then guided into the vicinity of the warhead of the enemy missile and caused to explode. The friendly guided missile includes an active radar target seeker provided with a transmit/receive antenna, a high frequency component, an oscillator, a range gate filter bank and an evaluation and control unit.

14 Claims, 2 Drawing Sheets

METHOD OF INITIATING THE DETONATION OF A WARHEAD AND ARRANGEMENT FOR IMPLEMENTING THE METHOD

REFERENCE TO RELATED APPLICATIONS

This application claims the priority of Federal Republic of Germany application Ser. No. P 42 24 020.4 filed Jul. 22, 1992, which is incorporated herein by reference.

BACKGROUND OF THE INVENTION

The present invention relates to a method of initiating the detonation of a warhead which is a component of a guided flying body or missile for combatting the warhead of an incoming enemy missile and which includes an active radar target seeker provided with a transmit/-receive antenna and an evaluation and control unit. More particularly, the present invention relates to such a method wherein the active radar target seeker detects the position of the enemy missile by measuring its range and deriving signals therefrom with which, during its target tracking and target approach phase, the guided missile is guided toward the enemy missile and, wherein detonation of the warhead of the guided missile is initiated when the enemy missile is reached. The present invention also relates to an arrangement for implementing the method.

The above-mentioned method and the associated arrangement are employed, for example, to combat flying targets and are used with preference in the defense against flying bodies or missiles. The warhead for combatting the warhead of an incoming enemy flying body or missile is here a component of a guided missile. The guided missile includes an active radar target seeker provided with a transmit/receive antenna and an evaluation and control unit which are connected with one another by way of a high frequency component including an integrated oscillator. The active radar target seeker detects the position of the enemy missile by measuring its range and derives signals therefrom with which the guided missile is guided to the enemy missile during the target tracking and target approach phases. When the enemy missile is reached, the warhead of the guided missile is caused to detonate.

If the enemy flying body or missile is, for example, in a dive onto a ground target, it is of the utmost importance that the warhead of the enemy missile be destroyed while still in the air, that is, before the enemy missile reaches the ground target, so that damage to the ground target that could be caused by the enemy missile can be kept as low as possible. Defensive missiles provided with target seekers must therefore detect the enemy missile already at a great distance and must home in as closely as possible to its warhead. An active target seeker is able to measure the range of the enemy missile and thus, in principle, calculate the optimum location of detonation and, connected with it, the optimum time of detonation. The presently attainable precision in range measurements lies in a range of decimeters. All prior art methods for guiding flying bodies or missiles thus furnish a range measurement accuracy (from the warhead of the defensive missile to the warhead of the enemy missile) which lies higher by one to two powers of ten than the tolerable value for the optimum moment of detonation. This inaccuracy is caused primarily by interferences from the individual scattering centers of the attacking or enemy missile. Due to their statistical character, these interferences lead to a statistical ranging error which makes combatting the enemy missile drastically more difficult.

It is thus an object of the present invention, on the one hand, to provide a method of the above-mentioned type with which the position of the warhead of an enemy missile can be determined as precisely as possible and, on the other hand, to create an arrangement of the simplest possible configuration for implementing such a method.

SUMMARY OF THE INVENTION

The above object is achieved with respect to the method in that, if the warhead of the defensive guided missile is in a phase where it approaches the enemy missile, its active radar target seeker is switched to a fine range discrimination by means of a range gate filter bank, with an additional modulated signal being transmitted over the transmit/receive antenna of the active radar target seeker. This signal is received again after reflection at the enemy missile and, with the aid of the received signal, the evaluation and control unit of the active radar target seeker creates an image of the enemy missile from which the position of the warhead in the enemy flying body is preferably estimated or determined by comparison with stored data. The warhead of the defensive guided missile is then guided toward the warhead of the enemy missile and is caused to explode.

With respect to the arrangement, the solution of the problem at hand resides in that the defensive guided missile includes an active radar target seeker that is provided with a transmit/receive antenna, a high frequency (HF) component, an oscillator, a range gate filter bank and an evaluation and control unit.

A significant advantage of the present invention compared to prior art solutions is that enemy missiles can be attacked very effectively before they reach their targets in that the warhead of the defensive guided missile is guided into the immediate vicinity of the warhead of the enemy missile while still approaching the enemy missile, that is, far way from its target, and is then caused to explode in the vicinity of the enemy warhead.

The invention will be described below in greater detail for an example that is illustrated in the drawing figures.

DETAILED DESCRIPTION OF THE PREFERRED EMBODIMENT

Figure 1:
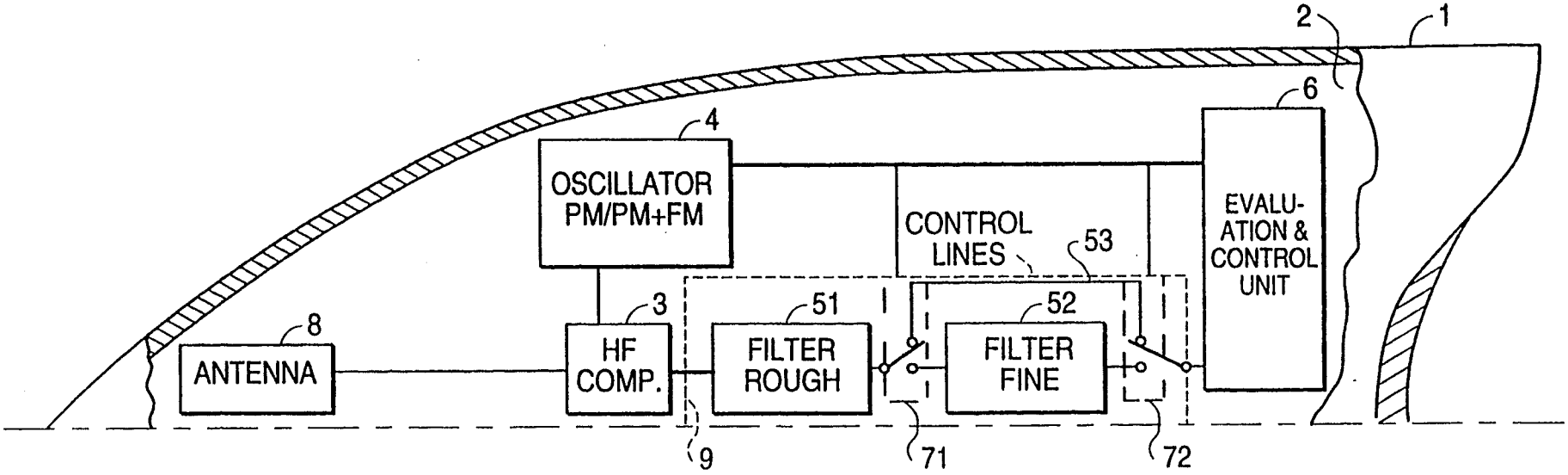
FIG. 1 is a longitudinal sectional view of a preferred embodiment of a portion of the defensive guided missile according to the invention.

The defensive missile or flying body 1 according to FIG. 1 includes an active radar target seeker provided with a transmit/receive antenna 8, a high frequency (HF) component 3, an oscillator 4, a range gate filter bank 9 and an evaluation and control unit 6. The transit/receive antenna 8, the HF component 3, the range gate filter bank 9 and the evaluation and control unit 6 are connected in series. The range gate filter bank 9 is composed of a first filter bank 51 for making a rough range discrimination, a second filter bank 52 for making a fine range discrimination, a first switch 71, a second switch 72, as well as a bridging branch 53 for bridging the second filter bank 52. The first switch 71 is disposed between the output of the first filter bank 51 and the input of the second filter bank 52 and the second switch 72 is disposed between the output of the second filter bank 52 and the input of the evaluation and control unit 6. Depending on the respective switch positions of the two switches 71 and 72, either the second filter bank 52 or the bridging branch 53 is open. The first filter bank 51, for example, has a width between about 2 to 200 meters, preferably between about 10 to 100 meters and the second filter bank 52 has a width, for example, between about 0 to 2 meters, preferably between about 25 to 100 centimeters. Oscillator 4 is connected to the HF component 3, and operates preferably in pulsed operation. During the target tracking phase the switches 71 and 72 are positioned to connect the branch 53 between the filter bank 51 and the unit 6, i.e., the filter bank 52 is bypassed, whereas during the target approach phase the switches 71 and 72 are positioned to connect the filter bank 52 into the circuit. During the target approach phase, the pulse signal (PM) of oscillator 4 has additionally a frequency modulated (FM) range discrimination signal superposed on it. The evaluation and control unit 6 actuates, i.e., controls oscillator 4 as well as the first and second switches 71 and 72.

When the warhead 2 of the defensive guided missile 1 approaches an enemy missile during a target approach phase, the active radar target seeker is switched to a fine range discrimination by means of the range gate filter bank 9, with an additional modulated signal being additionally transmitted over the transmit/receive antenna 8 of the active radar target seeker and being received again after reflection at the enemy missile.

With the aid of the received signal, the evaluation and control unit 6 of the active radar target seeker generates an image of the enemy missile 11 (see FIG. 2) and from it, for example, estimates the position of the warhead 12 in the enemy missile 11 or determines it by comparison of the image data with stored data. Then, that is during the final guidance phase, the warhead of the defensive guided missile is guided into the vicinity of the warhead 12 of the enemy missile 11 and there caused to explode.

The additional modulated signal employed is a frequency modulated signal, and preferably a frequency modulated signal that has a linear change in frequency.

By way of the transmit/receive antenna 8 of the active radar target seeker, the pulse signals from oscillator 4 are transmitted for the rough range discrimination, and after being reflected at the enemy missile 11 are received again by the transmit/receive antenna 8. During the target approach phase, the frequency modulated signal is superposed on the pulse signal.

The image of the enemy missile 11 results,—during the target tracking phase with the aid of the first filter bank 51 for a rough range discrimination and during the target approach phase with the aid of the first filter bank 51 and the subsequent second filter bank 52 for a fine range discrimination—from filtering of the received echo signals in the range gate filter bank 9.

During the transition from the target tracking phase to the target approach phase, the first and second filter banks 51 and 52 are disconnected.

Figure 2:
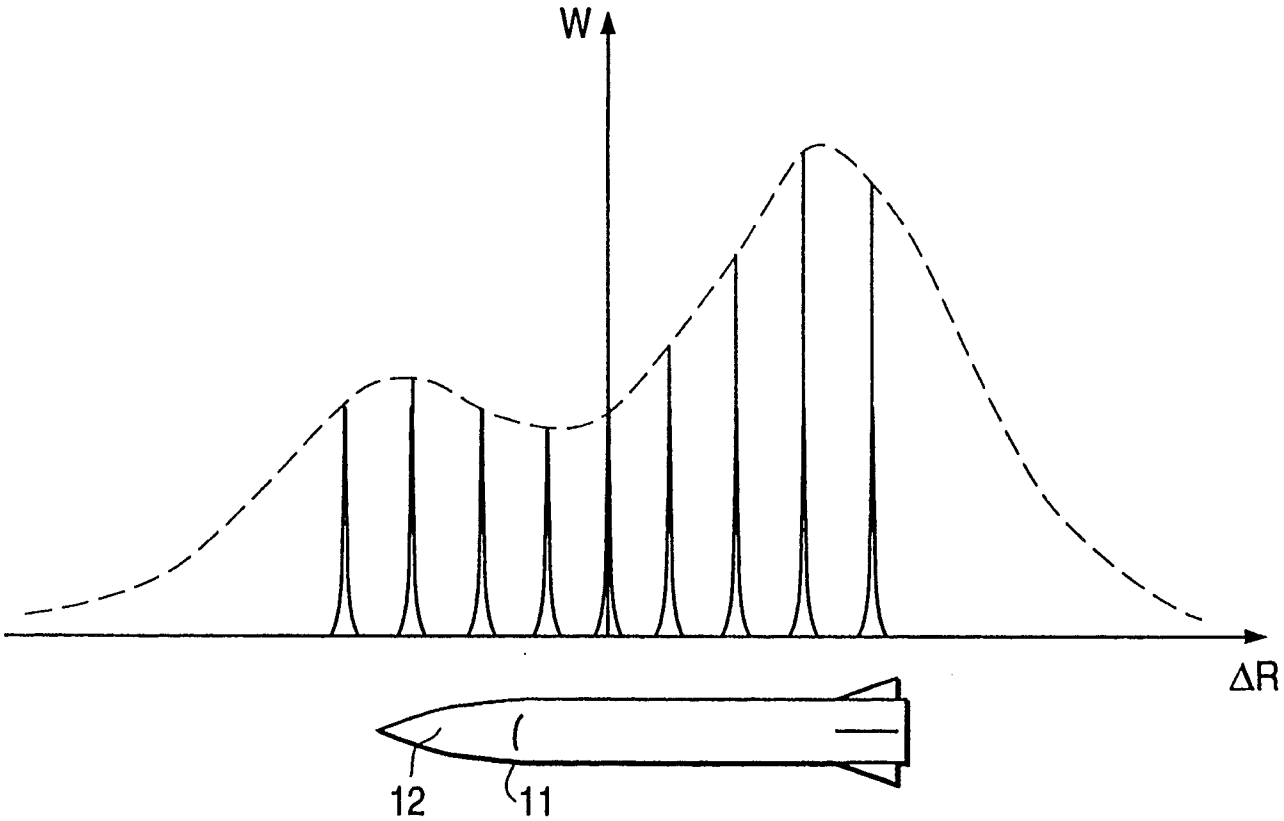
FIG. 2 depicts the image of a possible enemy missile that can be obtained with a preferred embodiment of the method according to the invention.

As an alternative to the above-described comparison of the image with stored data or estimation, FIG. 2 shows that an image of the enemy flying body 11 may also be generated in the evaluation and control unit 6. This image is produced in that, during the target seeking and target tracking phases, echo signals are selected in the first filter 51. If the resulting function is plotted as a probability distribution of the ranging error as a function of the deviation $\Delta R$ from the middle of an ideally tracking range gate (first filter), a steady function appears upstream of the first filter bank 51 (FIG. 1) as shown in dashed lines in FIG. 2. The peaks shown in FIG. 2 appear at the output of the first filter bank 51. During the target approach phase an additional modulated signal is transmitted as described above and approximately simultaneously an echo signal is selected, on the one hand, by means of the first filter bank 51 and, on the other hand, by means of a switched-in second filter bank 52 (see FIG. 1). Thus the distances between the peaks become smaller and the outline of the enemy missile 11 becomes more distinct.

The present invention is not limited to the illustrated embodiments but can be transferred to others as well. For example, it is possible to employ CW signals instead of pulse signals for the rough range discrimination.

The invention now being fully described, it will be apparent to one of ordinary skill in the art that any changes and modifications can be made thereto without departing from the spirit or scope of the invention as set forth herein.

What is claimed is:

1. In a method for initiating the detonation of a warhead which is a component of a guided missile for combatting the warhead of an incoming enemy missile, and which guided missile includes an active radar target seeker provided with a transmit/receive antenna, for transmitting a ranging signal and for receiving the ranging signal after reflection from a target, and an evaluation and control unit, said method including detecting the position of an enemy missile by measuring its range with the active radar target seeker using a range gate filter bank and deriving signals therefrom, guiding the guided missile, during its target tracking and target approach phases, toward the enemy missile using the derived signals and, initiating detonation of the warhead of the guided missile when the enemy missile is reached; the improvement comprising:

during the approach phase of the warhead of the guided missile to the enemy missile, switching a range gate filter bank of the active radar seeker from rough range discrimination to fine range discrimination, and, via the transmit/receive antenna of the active radar target seeker, transmitting an additional modulated signal together with the ranging signal and receiving the additional modulated signal reflected from the enemy missile;

in the evaluation and control unit of the active radar target seeker and with the aid of the received ranging and modulated signals, generating an image of the enemy missile and determining the position of the warhead within the enemy missile; and then guiding the warhead of the guided missile into the vicinity of the warhead of the enemy missile and causing the warhead of the guided missile to explode.

2. A method as defined in claim 1, wherein said step of determining the position of the warhead of the enemy missile includes estimating the position of the warhead from the image of the enemy missile.

3. A method as defined in claim 1, wherein said step of determining the position of the warhead of the enemy missile includes comparing the image of the enemy missile with stored data.

4. A method as defined in claim 1, wherein said additional modulated signal is a frequency modulated signal.

5. A method as defined in claim 4, wherein said additional modulated signal is a frequency modulated signal having a linear frequency change.

6. A method as defined in claim 1, wherein said step of generating an image of the enemy missile includes generating the image during the target tracking phase with the aid of output signals of a first filter bank for rough range discrimination and during the target approach phase with the aid of output signals of the first filter bank and a subsequent second filter bank for fine range discrimination, with the first and second filter banks being components of the range gate filter bank.

7. A method as defined in claim 6, wherein the first filter bank has a width between about 2 and 200 meters and the second filter bank has a width between 0 and 2 meters.

8. A method as defined in claim 7, wherein the first filter bank has a width between about 10 and 100 meters and the second filter bank has a width between 25 and 100 centimeters.

9. A method as defined in claim 6, wherein the first and second filter banks are disconnected during the transition from the target tracking phase to the target approach phase.

10. A method as defined in claim 9, wherein the transmit/receive antenna of the active radar target seeker transmits pulse signals for a rough range discrimination and the additional modulated signal transmitted during the target approach phase is a frequency modulated signal superposed on the pulse signal.

11. In an arrangement for initiating the detonation of a warhead which is a component of a guided missile for combatting the warhead of an incoming enemy missile wherein the guided missile includes an active radar target seeker provided with a transmit/receive antenna, a high frequency component, an oscillator, a range gate filter bank and an evaluation and control unit, with the transmit/receive antenna, the high frequency component, the range gate filter bank and the evaluation and control unit being connected in series, and with the oscillator being connected to the high frequency component, and wherein said evaluation and control unit is responsive to ranging signals produced by the oscillator and transmitted via the antenna and, after reflection from an enemy missile, received by said antenna to measure the range of the enemy missile and to guide the guided missile, during its target tracking and target approach phases, toward the enemy missile and to initiate detonation of the warhead when the enemy missile is reached; the improvement wherein: said range gate filter bank comprises a first filter bank for rough range discrimination, a second filter bank for fine range discrimination, a first switch, a second switch, and a bridging branch for bridging said second filter bank, with said first switch selectively connecting the output of said first filter bank either to the input of said second filter bank or to one end of said bridging branch, and said second switch selectively connecting the input of said evaluation and control unit either to the output of said second filter bank or to the other end of said bridging branch; and said evaluation and control unit controls said first and second switches to connect said bridging branch between said output of said first filter bank and said input of said evaluation and control unit to provide rough range discrimination during the tracking phase of said guided missile, and is responsive to the received ranging signals to cause said oscillator to produce a modulated additional signal for transmission together with the ranging signal and to control said first and second switches to connect said second filter bank between said output of said first filter bank and said input of said evaluation and control unit to provide fine range discrimination during the approach phase of said guided missile.

12. An arrangement as defined in claim 11, wherein said first filter bank has a width between about 2 to 200 meters, and said second filter bank has a width between about 0 to 2 meters.

13. An arrangement as defined in claim 12, wherein said first filter bank has a width between about 10 to 100 meters and said second filter bank has a width between about 25 to 100 centimeters.

14. An arrangement as defined in claim 11, wherein said oscillator operates in pulse operation and said additional signal is a frequency modulated signal for fine range discrimination superposed on the pulse signal of the oscillator.

* * * * *